US009324494B2

(12) United States Patent
Kuniyoshi et al.

(10) Patent No.: US 9,324,494 B2
(45) Date of Patent: Apr. 26, 2016

(54) TREATMENT DEVICE

(75) Inventors: Futoshi Kuniyoshi, Mishima-gun (JP); Shohji Nakayama, Kumagaya (JP)

(73) Assignee: HITACHI METALS, LTD., Tokyo (JP)

( * ) Notice: Subject to any disclaimer, the term of this patent is extended or adjusted under 35 U.S.C. 154(b) by 469 days.

(21) Appl. No.: 13/809,198

(22) PCT Filed: Jul. 11, 2011

(86) PCT No.: PCT/JP2011/065804

§ 371 (c)(1),
(2), (4) Date: Jan. 9, 2013

(87) PCT Pub. No.: WO2012/008416

PCT Pub. Date: Jan. 19, 2012

(65) Prior Publication Data

US 2013/0112141 A1 May 9, 2013

(30) Foreign Application Priority Data

Jul. 13, 2010 (JP) ..... 2010-158363

(51) Int. Cl.

| | |
|---|---|
| ***H01F 41/02*** | (2006.01) |
| ***B22F 3/24*** | (2006.01) |
| ***C21D 9/00*** | (2006.01) |
| ***C22C 33/02*** | (2006.01) |
| ***C22C 38/00*** | (2006.01) |
| ***C23C 10/28*** | (2006.01) |
| ***F27B 7/02*** | (2006.01) |
| ***F27B 7/16*** | (2006.01) |
| ***F27B 7/22*** | (2006.01) |
| ***F27B 7/33*** | (2006.01) |
| ***C22C 1/02*** | (2006.01) |
| *H01F 1/057* | (2006.01) |

(Continued)

(52) U.S. Cl.

CPC ..... *H01F 41/0293* (2013.01); *B22F 3/24* (2013.01); *C21D 9/0018* (2013.01);

(Continued)

(58) Field of Classification Search

CPC .. C22B 7/004; C22B 21/0069; C21D 9/0031; C23C 16/46; C23B 59/00; H01L 21/67098

USPC ..... 266/205, 901, 173, 213; 148/101, 122, 148/301; 118/724

See application file for complete search history.

(56) References Cited

U.S. PATENT DOCUMENTS 2,039,062 A * 4/1936 Debuch ..... 423/110
4,090,622 A * 5/1978 Smith et al. ..... 414/149

(Continued)

FOREIGN PATENT DOCUMENTS

JP 04-078473 A 3/1992
JP 05-138053 A 6/1993

(Continued)

OTHER PUBLICATIONS

Official Communication issued in International Patent Application No. PCT/JP2011/065804, mailed on Oct. 11, 2011.

(Continued)

*Primary Examiner* — Scott Kastler
*Assistant Examiner* — Michael Aboagye
(74) *Attorney, Agent, or Firm* — Keating & Bennett, LLP

(57) ABSTRACT

A processing system according to the present invention includes: a diffusion processing section 10 which heats a sintered R-T-B based magnet body 1 and an RH diffusion source 2 made of either a metal or alloy of a heavy rare-earth element RH (which is at least one of Dy and Tb) while rotating; a sorting section 20 which selectively sorts the RH diffusion source 2 from the sintered R-T-B based magnet body 1 when the diffusion source and the magnet body come from the diffusion processing section 10; and a heat treatment processing section 30 which conducts a heat treatment process on the sintered R-T-B based magnet body 1, in which the heavy rare-earth element RH has been diffused and from which the RH diffusion source 2 has been removed.

3 Claims, 7 Drawing Sheets

(52) U.S. Cl.
CPC ..... *C21D 9/0031* (2013.01); *C21D 9/0056* (2013.01); *C21D 9/0068* (2013.01); *C22C 1/02* (2013.01); *C22C 33/0278* (2013.01); *C22C 38/00* (2013.01); *C23C 10/28* (2013.01); *F27B 7/02* (2013.01); *F27B 7/16* (2013.01); *F27B 7/22* (2013.01); *F27B 7/33* (2013.01); *C21D 2281/00* (2013.01); *H01F 1/0577* (2013.01)

(56) References Cited

U.S. PATENT DOCUMENTS

| | | | | |
|---|---|---|---|---|
| 4,443,186 | A * | 4/1984 | Shell | F26B 3/28 126/569 |
| 4,728,352 | A * | 3/1988 | Goode et al. | 65/27 |
| 5,054,747 | A * | 10/1991 | Perry | 266/205 |
| 2008/0286595 | A1 | 11/2008 | Yoshimura et al. | |
| 2012/0112863 | A1 | 5/2012 | Kuniyoshi | |

FOREIGN PATENT DOCUMENTS

| | | | |
|---|---|---|---|
| JP | 06-221765 | A | 8/1994 |
| JP | 10-300356 | A | 11/1998 |
| JP | 2004-296973 | A | 10/2004 |
| JP | 2009-194262 | A | 8/2009 |
| WO | 2007/102391 | A1 | 9/2007 |
| WO | 2011/007758 | A1 | 1/2011 |

OTHER PUBLICATIONS

English translation of Official Communication issued in corresponding International Application PCT/JP2011/065804, mailed on Feb. 21, 2013.

* cited by examiner (a)

(b)

(c)

(d)

(a)

(b)

TREATMENT DEVICE

TECHNICAL FIELD

The present invention relates to a processing system which diffuses a heavy rare-earth element RH (which is at least one of Dy and Tb) inside of a sintered R-T-B based magnet.

BACKGROUND ART

A sintered R—Fe—B based magnet, including an $R_2T_{14}B$ type compound as a main phase, is known as a permanent magnet with the highest performance, and has been used in various types of motors such as a voice coil motor (VCM) for a hard disk drive and a motor for a hybrid car and in numerous types of consumer electronic appliances.

As a sintered R-T-B based magnet loses its coercivity at high temperatures, such a magnet will cause an irreversible flux loss. For that reason, when used in a motor, for example, the magnet should maintain coercivity that is high enough even at elevated temperatures to minimize the irreversible flux loss.

It is known that if the $R_2T_{14}B$ type compound phase is partially replaced with a heavy rare-earth element RH (which may be Dy and/or Tb), the coercivity of a sintered R-T-B based magnet will increase. It has been considered effective to add a lot of such a heavy rare-earth element RH to the sintered R-T-B based magnet to achieve high coercivity even at a high temperature.

However, if the light rare-earth element RL (which may be at least one of Nd and Pr) is replaced with the heavy rare-earth element RH in a sintered R-T-B based magnet, the coercivity certainly increases but the remanence decreases instead. Furthermore, as the heavy rare-earth element RH is one of rare natural resources, its use should be cut down.

For these reasons, various methods for increasing the coercivity of a sintered magnet effectively with the addition of as small an amount of the heavy rare-earth element RH as possible have recently been researched and developed in order to avoid decreasing the remanence. The applicant of the present application already disclosed, in Patent Document No. 1, a method for diffusing a heavy rare-earth element RH inside of a sintered R—Fe—B based magnet body while supplying the heavy rare-earth element RH onto the surface of the sintered R-T-B based magnet body (which will be referred to herein as an "evaporation diffusion process"). According to the method disclosed in Patent Document No. 1, inside of a diffusion processing system made of a refractory metallic material, the sintered R-T-B based magnet body and an RH bulk body are arranged so as to face each other with a predetermined gap left between them. The diffusion processing system includes a member for holding multiple sintered R-T-B based magnet bodies and a member for holding the RH bulk body. A method that uses such a system requires a series of process steps of arranging the RH bulk body in the diffusion processing apparatus, introducing a holding member and a net, putting the sintered R-T-B based magnet bodies on the net, mounting the holding member beside the sintered magnet bodies and mounting the net on the sintered magnet bodies, putting the upper RH bulk body on the net, and sealing the diffusion processing system hermetically and carrying out an evaporation diffusion.

Patent Document No. 2 discloses that in order to improve the magnetic properties of an R-T-B based intermetallic compound magnetic material, a powder of Yb metal with a low boiling point and a sintered R-T-B based magnet compact are sealed and heated in a thermally resistant hermetic container, thereby depositing uniformly a coating of Yb metal on the surface of the sintered magnet compact and diffusing a rare-earth element inside of the sintered magnet body from that coating (see, in particular, Example #5 of Patent Document No. 2).

CITATION LIST

Patent Literature

Patent Document No. 1: PCT International Application Domestic Re-publication No. 2007/102391

Patent Document No. 2: Japanese Laid-Open Patent Publication No. 2004-296973

SUMMARY OF INVENTION

Technical Problem

According to the method of Patent Document No. 1, however, sintered R-T-B based magnet bodies and an RH bulk body of a heavy rare-earth element RH need to be arranged in a diffusion processing system so as to be spaced apart from each other. That is why it takes a lot of time and trouble to perform the arranging process step and its mass productivity is inferior to other methods. In addition, since Dy or Tb needs to be supplied by subliming it, it takes a long time to achieve higher coercivity by increasing the rate of diffusion of the heavy rare-earth element RH into the sintered R-T-B based magnet body.

On the other hand, according to the disclosure of Patent Document No. 2, if the rare-earth metal in question has as high a saturated vapor pressure as Yb, Eu or Sm, deposition of its coating onto the sintered magnet body and diffusion of that element from the coating can be done by carrying out a heat treatment within the same temperature range (e.g., 800° C. to 850° C.). However, to coat the surface of a sintered R-T-B based magnet body with a deposited film of a rare-earth element with a low vapor pressure such as Dy or Tb, the rare-earth metal should be heated selectively to high temperatures by performing an inductive heating process using an RF heating coil. And to heat Dy or Tb to a higher temperature than the sintered R-T-B based magnet body, Dy or Tb and the sintered R-T-B based magnet body should be spaced apart from each other. That is why according to the basic technical idea and method of Patent Document No. 2, a thick coating of Dy or Tb is deposited (to several ten μm or more, for example) on the surface of the sintered R-T-B based magnet body. Then, Dy or Tb will diffuse and enter the inside of the main phase crystal grains in the vicinity of the surface of the sintered R-T-B based magnet body, thus causing a decrease in remanence $B_r$.

The present inventors perfected our invention in order to overcome these problems and an object of the present invention is to provide a processing system which contributes to mass production by diffusing a heavy rare-earth element RH such as Dy or Tb from the surface of a sintered R-T-B based magnet body inside the body without decreasing the remanence.

Solution to Problem

A processing system according to the present invention includes: a diffusion processing section which heats an RH diffusion source made of either a metal or alloy of a heavy rare-earth element RH (which is at least one of Dy and Tb) and a sintered R-T-B based magnet body while rotating; a sorting section which is adjacent to the diffusion processing section and which selectively sorts the RH diffusion source from the sintered R-T-B based magnet body when the diffusion source and the magnet body come from the diffusion processing section; and a tilting mechanism which tilts the diffusion processing section and the sorting section.

In one preferred embodiment, the sorting section has a plurality of holes to eject the RH diffusion source out of itself, and each of those holes has a smaller size than the sintered R-T-B based magnet body.

In one preferred embodiment, the sorting section sends the sintered R-T-B based magnet body back to the diffusion processing section while being rotated, and the diffusion processing section does a heat treatment on the sintered R-T-B based magnet body that has come back from the sorting section.

In one preferred embodiment, the diffusion processing section has a first outer wall portion that surrounds a first inner wall portion. The sorting section has a second outer wall portion that surrounds a second inner wall portion. And at least the first inner wall portion has a cylindrical shape and is made of either a metal or alloy including at least one of Mo, W, Nb and Ta.

In a more preferred embodiment, a sheet-like padding member is arranged either between each pair of the inner and outer wall portions.

In one preferred embodiment, a spiral baffle is arranged on the inner wall portion of the diffusion processing section. The baffle of the diffusion processing section passes the RH diffusion source and the sintered R-T-B based magnet body from the diffusion processing section to the sorting section when rotating in a first direction but keeps the RH diffusion source and the sintered R-T-B based magnet body in the diffusion processing section when rotating in a second direction that is opposite to the first direction.

Another processing system according to the present invention includes: a diffusion processing section which heats an RH diffusion source made of either a metal or alloy of a heavy rare-earth element RH (which is at least one of Dy and Tb) and a sintered R-T-B based magnet body while rotating; a sorting section which is adjacent to the diffusion processing section and which selectively sorts the RH diffusion source from the sintered R-T-B based magnet body when the diffusion source and the magnet body come from the diffusion processing section; a heat treatment processing section which is adjacent to the sorting section and which conducts a heat treatment process on the sintered R-T-B based magnet body, in which the heavy rare-earth element RH has been diffused by the diffusion processing section and from which the RH diffusion source has been removed, while rotating, and a tilting mechanism which tilts at least the diffusion processing section, the sorting section and the heat treatment processing section.

In one preferred embodiment, the sorting section has a plurality of holes to eject the RH diffusion source out of itself while moving the RH diffusion source and the sintered R-T-B based magnet body that have come from the diffusion processing section toward the heat treatment processing section.

In one preferred embodiment, the diffusion processing section has a first cylindrical inner wall portion which houses the RH diffusion source and the sintered R-T-B based magnet body, and passes the RH diffusion source and the sintered R-T-B based magnet body to the sorting section while being rotated by the driving section. The sorting section has a second cylindrical inner wall portion which houses the RH diffusion source and the sintered R-T-B based magnet body and which has holes, ejects the RH diffusion source through the holes out of itself and passes the sintered R-T-B based magnet body to the heat treatment processing section while being rotated by the driving section. And the heat treatment processing section has a third cylindrical inner wall portion which houses the sintered R-T-B based magnet body, and passes the sintered R-T-B based magnet body to an outlet port while being rotated by the driving section.

In one preferred embodiment, a spiral baffle is arranged on the inner wall portion of each of the diffusion processing section and the heat treatment processing section. And the baffle of the diffusion processing section is arranged so that its spiral direction is reverse to that of the baffle of the heat treatment processing section.

In one preferred embodiment, the diffusion processing section has a first outer wall portion that surrounds the first inner wall portion. The sorting section has a second outer wall portion that surrounds the second inner wall portion. The heat treatment processing section has a third outer wall portion that surrounds the third inner wall portion. And at least the first and third inner wall portions have a cylindrical shape and are made of either a metal or alloy including at least one of Mo, W, Nb and Ta.

In one preferred embodiment, a sheet-like padding member is arranged between each said pair of inner and outer wall portions.

Advantageous Effects of Invention

According to the present invention, the system includes a diffusion processing section which heats an RH diffusion source made of either a metal or alloy of a heavy rare-earth element RH (which is at least one of Dy and Tb) and a sintered R-T-B based magnet body while rotating, and a sorting section which selectively sorts the RH diffusion source. Thus, a sintered magnet body with increased coercivity can be made efficiently and smoothly from the RH diffusion processing step through the heat treatment processing step without decreasing the remanence.

DESCRIPTION OF EMBODIMENTS

Figure 1:
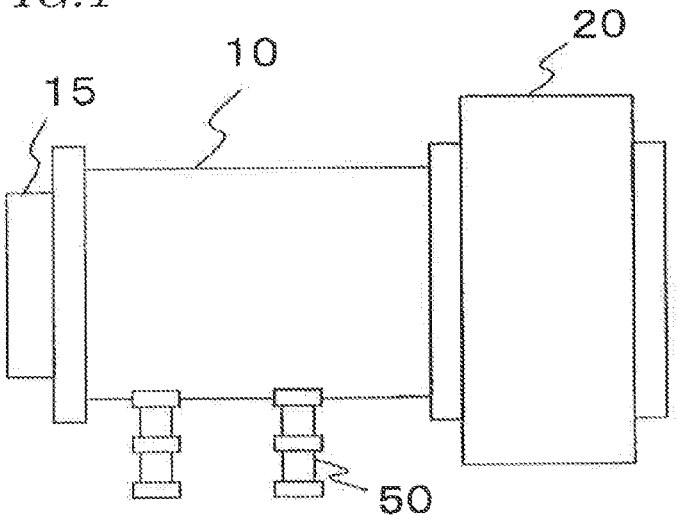
FIG. 1 Illustrates a configuration for a processing system as an embodiment of the present invention.

A processing system according to the present invention includes a diffusion processing section which can heat an RH diffusion source and a sintered R-T-B based magnet body and can rotate them in order to stir them up. In this case, the RH diffusion source is made of a metal or alloy of a heavy rare-earth element RH (which is at least one of Dy and Tb). A preferred embodiment of the RH diffusion source will be described later.

In the diffusion processing section, a number of RH diffusion sources and a number of sintered R-T-B based magnet bodies are heated together at first, thereby supplying the heavy rare-earth element RH from the RH diffusion sources to the sintered R-T-B based magnet bodies. The RH diffusion sources and the sintered R-T-B based magnet bodies that have been loaded into the diffusion processing section are not fixed by any holder but are movable with respect to each other. And as the diffusion processing section rotates, these RH diffusion sources and sintered R-T-B based magnet bodies can move and can be brought close to, or in contact with, each other in the diffusion processing section.

As the diffusion processing section rotates, the RH diffusion sources and the sintered R-T-B based magnet bodies are suitably heated to, and maintained at, a temperature of 500° C. to 1000° C. by heating means while being brought close to, or away from, each other. As the diffusion processing section rotates, the sintered R-T-B based magnet bodies and the RH diffusion sources move either continuously or discontinuously in the diffusion processing section. That is why points of contact between the sintered R-T-B based magnet bodies and the RH diffusion sources constantly change and the sintered R-T-B based magnet bodies and the RH diffusion sources repeatedly come into and out of contact with each other. By continuing such a movement in the heated state, the heavy rare-earth element RH can not only be supplied from the RH diffusion sources to the sintered R-T-B based magnet bodies but also diffuse inside of the sintered R-T-B based magnet bodies (i.e., an RH diffusion process is carried out).

A processing system according to the present invention includes a sorting section which selectively sorts out the RH diffusion sources from the sintered R-T-B based magnet bodies when the RH diffusion sources and the sintered R-T-B based magnet bodies come from the diffusion processing section after having been subjected to the RH diffusion process.

After the RH diffusion sources have been sorted out, the diffusion processing section may be used to conduct a heat treatment process only on the sintered R-T-B based magnet bodies.

A processing system according to the present invention may further include a heat treatment processing section which conducts an additional heat treatment process on the sintered R-T-B based magnet bodies to which the heavy rare-earth element RH has been supplied and diffused by the diffusion processing section. In this case, the "additional heat treatment process" conducted by the heat treatment processing section is supposed to be carried out after the RH diffusion sources have been removed. And by carrying out this additional heat treatment process, the heavy rare-earth element RH that has been supplied from the RH diffusion sources to the sintered R-T-B based magnet bodies in the diffusion processing section can be diffused even deeper inside of the sintered R-T-B based magnet bodies.

In a preferred embodiment, the sorting section has holes, through which the RH diffusion sources are selectively ejected out of itself while the RH diffusion sources and the sintered R-T-B based magnet bodies that have come from the diffusion processing section are transferred toward the heat treatment processing section. By ejecting the RH diffusion sources out of the sorting section in this manner, the process can advance to the next heat treatment processing step smoothly.

In a preferred embodiment, the diffusion processing section, sorting section and heat treatment processing section according to the present invention can heat the processing objects such as the sintered R-T-B based magnet bodies and the RH diffusion sources while rotating in a tilted position.

According to the present invention, these processing objects including the sintered R-T-B based magnet bodies and the RH diffusion sources can be moved sequentially from the diffusion processing section to the sorting section and from the sorting section to the heat treatment processing section without being exposed to the air.

EMBODIMENTS

Hereinafter, preferred embodiments of a processing system according to the present invention will be described with reference to the accompanying drawings. It should be noted that the present invention is in no way limited to the embodiments to be described below.

FIG. 1 generally illustrates a configuration for a processing system as an embodiment of the present invention. The processing system illustrated in FIG. 1 includes a diffusion processing section 10 which carries out an RH diffusion process and, if necessary, a heat treatment process, and a sorting section 20 which selectively sorts out the RH diffusion sources 2 from the sintered R-T-B based magnet bodies 1 when the RH diffusion sources 2 and the sintered R-T-B based magnet bodies come from the diffusion processing section 10 and, if necessary, sends only the sintered R-T-B based magnet bodies 1 that have been subjected to the RH diffusion process back to the diffusion processing section 10. In this embodiment, the sorting section 20 is coupled to the diffusion processing section 10. The diffusion processing section 10 and the sorting section 20 may be connected together with a faucet joint. While sequentially going through the RH diffusion processing step, the RH diffusion source sorting processing step, and the heat treatment processing step, the sintered R-T-B based magnet bodies 1 are never exposed to the air. In the RH diffusion source sorting processing step to be performed between the RH diffusion processing step and the heat treatment processing step, the RH diffusion sources are sorted out non-manually, and therefore, can be separated without lowering the processing temperature. As a result, the productivity can be increased from the RH diffusion processing step through the heat treatment processing step. The diffusion processing section 10 and the sorting section 20 are directly coupled together in the example shown in FIG. 1 but may also be connected together with a connecting tube.

The diffusion processing section 10 has an inlet port 15, through which the sintered R-T-B based magnet bodies 1 and RH diffusion sources 2 yet to be subjected to the RH diffusion process are loaded into the diffusion processing section 10. When subjected to the RH diffusion processing step, the sorting processing step, and the heat treatment processing step, the sintered R-T-B based magnet bodies 1 will be unloaded through the inlet port 15.

In the example shown in FIG. 1, the diffusion processing section 10 connected to the sorting section 20 is implemented as a connecting tube and supported in a rotatable position.

At least one of the diffusion processing section 10 and the sorting section 20 is provided with a tilting mechanism 50 to tilt the diffusion processing section 10 and the sorting section 20. Thanks to the action of the tilting mechanism 50, the diffusion processing section 10 and the sorting section 20 can be either leveled or tilted. In this embodiment, the diffusion processing section 10 and the sorting section 20 can get tilted altogether, and can be rotated by a motor (not shown). No matter whether they are leveled or tilted, the diffusion processing section 10 and the sorting section 20 can always rotate. And the direction and velocity of their rotation may be set arbitrarily.

Figure 2:
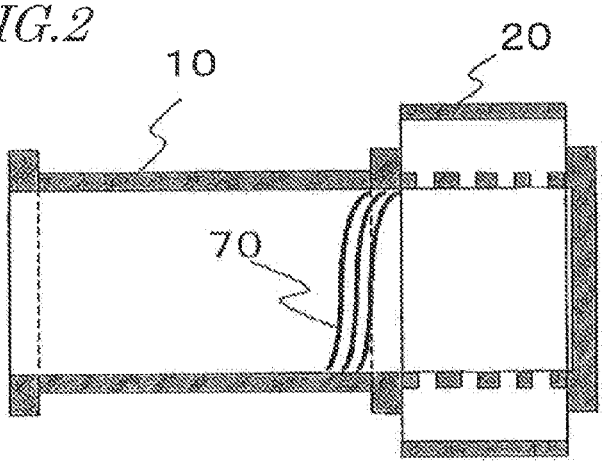
FIG. 2 Schematically illustrates a cross-sectional structure of the processing system according to the embodiment shown in FIG. 1.

Next, look at FIG. 2, which schematically illustrates a cross-sectional structure of the processing system shown in FIG. 1.

As shown in FIG. 2, the diffusion processing section 10 has an inner space to house the RH diffusion sources 2 and the sintered R-T-B based magnet bodies 1 and can forward the RH diffusion sources 2 and the sintered R-T-B based magnet bodies 1 to the sorting section 20 by rotating with the sorting section 20 tilted downward. Optionally, by tilting the sorting section 20 in reverse direction (i.e., upward), the sintered R-T-B based magnet bodies 1 can be sent back from the sorting section 20 to the diffusion processing section 10. By turning in such a tilted position, the sorting section 20 can also sort only the RH diffusion sources 2 from the sintered R-T-B based magnet bodies 1 and eject the RH diffusion sources 2 out of itself efficiently.

It is recommended that the diffusion processing section 10 be made of a material that can withstand the heat at approximately 500 to 1000° C. and that does not easily react with the sintered R-T-B based magnet bodies 1 or the RH diffusion sources 2 at least on its inner wall portion, which may be made of a metal selected from the group consisting of Nb, Mo, W and Ta or an alloy including at least one of these elements. Alternatively, the inner wall portion may also be made of an Fe—Cr—Al based alloy or an Fe—Cr—Co based alloy. The same can be said about the sorting section 20 to be described later.

Figure 3:
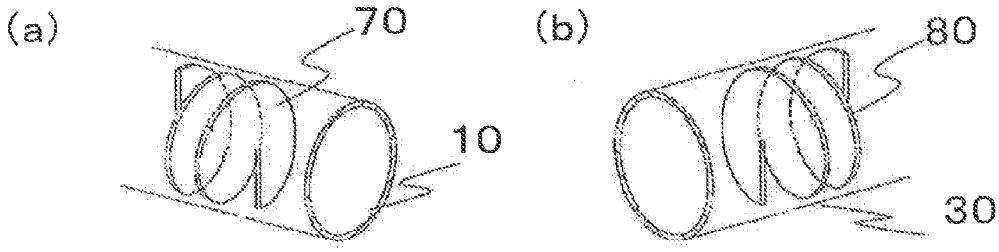
FIG. 3 (*a*) is a perspective view illustrating an exemplary configuration for a spiral baffle 70 and (*b*) is a perspective view illustrating an exemplary configuration for a baffle 80.
Figure 6:
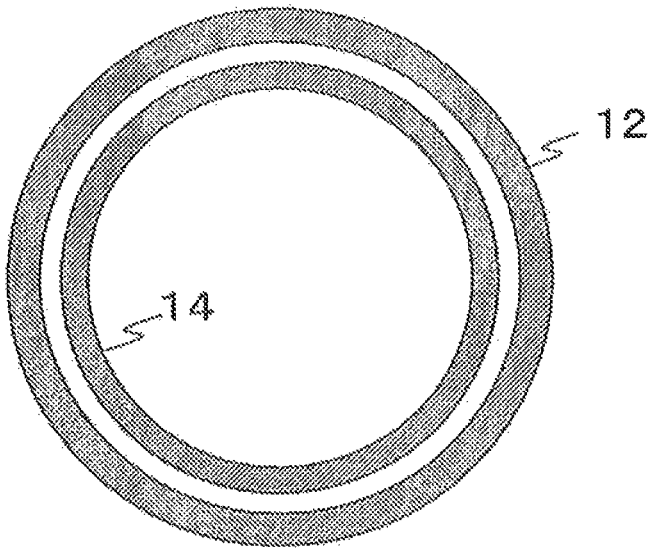
FIG. 6 (*a*) illustrates an exemplary cross-sectional structure of the diffusion processing section 10 as viewed on a plane that intersects with the longitudinal direction at right angles, and (*b*) is a cross-sectional view illustrating a preferred embodiment of the inner wall portion.
Figure 6:
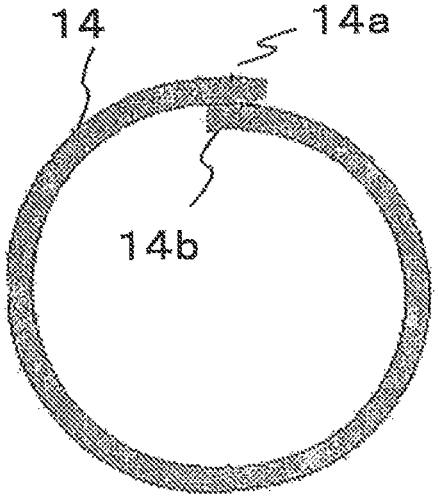

FIG. 6(*a*) illustrates an exemplary cross section of the diffusion processing section 10 as viewed on a plane that intersects with its axis at right angles. In this example, the diffusion processing section 10 includes a cylindrical inner wall portion 14 made of the metal or alloy mentioned above and an outer wall portion 12 which surrounds the inner wall portion 14. The outer wall portion 12 may be made of stainless steel. In this example, the inner wall portion 14 of the diffusion processing section 10 is designed and connected so as to have the same diameter as its counterpart 14 of the sorting section 20 at least where the respective inner wall portions 14 of the diffusion processing section 10 and the sorting section 20 contact with each other. Thus, the sintered R-T-B based magnet bodies 1 and the RH diffusion sources 2 can move smoothly from the diffusion processing section 10 into the sorting section 20, and vice versa. Furthermore, in order to carry the RH diffusion sources 2 and the sintered R-T-B based magnet bodies 1 to the sorting section 20, baffles 70 and 80 as shown in FIGS. 3(*a*) and 3(*b*) are arranged inside of the inner wall portion 14. Each of those baffles is usually connected to the inner wall portion so as to rotate along with the diffusion processing section. However, the baffle does not have to be connected to the inner wall portion but may rotate by itself.

In this embodiment, the temperature could change by nearly 900° C. before and after the RH diffusion process is started. That is why in a situation where the outer and inner wall portions 12 and 14 are made of materials with different thermal expansion coefficients, if the outer and inner wall portions 12 and 14 were fixed in close contact with each other, then the outer and inner wall portions 12 and 14 could peel from each other or the inner wall portion 14 could crack due to thermal expansion or shrinkage. That is why if the outer and inner wall portions 12 and 14 are made of materials with different thermal expansion coefficients, the outer and inner wall portions 12 and 14 suitably have a gap left between them and fixed with bolts in order to prevent the outer and inner wall portions 12 and 14 from colliding against each other. More suitably, a sheet-like padding member is arranged between the outer and inner wall portions 12 and 14. This padding member is suitably made of either a carbon or ceramic material with thermal resistance or a metallic material that can withstand the heat, and may also be made of a nonwoven fabric such as thermally resistant felt.

FIG. 6(*b*) illustrates another configuration for the inner wall portion 14. The inner wall portion 14 shown in FIG. 6(*b*) is obtained by rounding a metal plate into a cylindrical shape and is designed so that one end 14*a* and the other end 14*b* thereof overlap with each other at an ordinary temperature. The one end 14*a* and the other end 14*b* of the metal plate that forms the inner wall portion 14 are not fixed but their degree of overlap may change according to the magnitude of thermal expansion or shrinkage. That is why even if the temperature has changed by as much as about 900° C. to change the outside diameter of the inner wall portion 14 significantly, it is still possible to prevent effectively the inner wall portion 14 from colliding against the outer wall portion 12. Optionally, the padding member mentioned above may be further interposed between the outer wall portion 12 and the inner wall portion 14.

The cross section of the outer and inner wall portions 12 and 14 of the diffusion processing section 10 as viewed on a plane that intersects with their axis at right angles does not have to be a circular one but may also be an elliptical, polygonal or any other appropriate shape. Optionally, to stir the sintered R-T-B based magnet bodies 1 and RH diffusion sources 2 more briskly while the diffusion processing section 10 is rotating, the inner wall portion 14 of the diffusion processing section 10 may have projections.

Now take a look at FIG. 2 again.

In this embodiment, a first spiral baffle 70 is arranged inside of the diffusion processing section 10. The first baffle 70 may have the configuration shown in FIG. 3(*a*), for example. When the diffusion processing section 10 rotates in a first direction (e.g., clockwise if this processing system is viewed from the left-hand side of the paper on which FIG. 1 is drawn), the first baffle 70 can pass the RH diffusion sources 2 and the sintered R-T-B based magnet bodies 1 to the sorting section 20. On the other hand, if the diffusion processing section 10 rotates in a second direction which is opposite to the first direction, the first baffle 70 can keep the RH diffusion sources 2 and the sintered R-T-B based magnet bodies 1 inside. The diameter of the first baffle 70 may be smaller than the inside diameter of the inner wall portion 14. In that case, the clearance left between the inner wall portion 14 and the first baffle 70 needs to be set so as to prevent the RH diffusion sources 2 and the sintered R-T-B based magnet bodies 1 to introduce from dropping through the gap.

In the example illustrated in FIG. 2, the first baffle 70 is provided for the diffusion processing section 10. However, the first baffle 70 may also be arranged in the sorting section 20 or to cover both the diffusion processing section 10 and the sorting section 20.

Hereinafter, it will be described with reference to FIGS. 4(*a*) through 4(*d*) and FIG. 5 exactly how the processing system of this embodiment operates.

First of all, an example of the sintered R-T-B based magnet body 1 and RH diffusion source 2 for use in a preferred embodiment of the present invention will be described. To begin with, a sintered R-T-B based magnet body in which a heavy rare-earth element RH needs to be diffused is provided according to the present invention. The sintered R-T-B based magnet body to provide according to the present invention has a known composition. For example, the sintered R-T-B based magnet body may have a composition consisting of 12 to 17 at % of a rare-earth element R, 5 to 8 at % of B (which may be partially replaced with C), 0 to 2 at % of an additive element M (which is at least one element selected from the group consisting of Al, Ti, V, Cr, Mn, Ni, Cu, Zn, Ga, Zr, Nb, Mo, Ag, In, Sn, Hf, Ta, W, Pb and Bi) and T (which is a transition metal consisting mostly of Fe and which may include Co) as the balance.

In this case, the rare-earth element R is at least one element, which is selected from the light rare-earth elements RL in most cases but which may include a heavy rare-earth element RH as well. In that case, the heavy rare-earth element RH suitably includes at least one of Dy and Tb.

It should be noted that if a lot of heavy rare-earth element RH were added to the sintered R-T-B based magnet body, the effect of the present invention could not be achieved fully. For that reason, a relatively small amount of heavy rare-earth element RH may be added to the sintered R-T-B based magnet body.

The sintered R-T-B based magnet body with such a composition may be made by a known manufacturing process.

RH Diffusion Process

Figure 4:
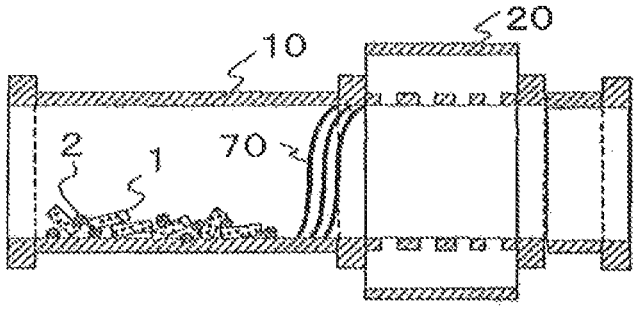
FIG. 4 (*a*) through (*d*) illustrate how the processing system according to the embodiment shown in FIG. 1 operates.
Figure 4:
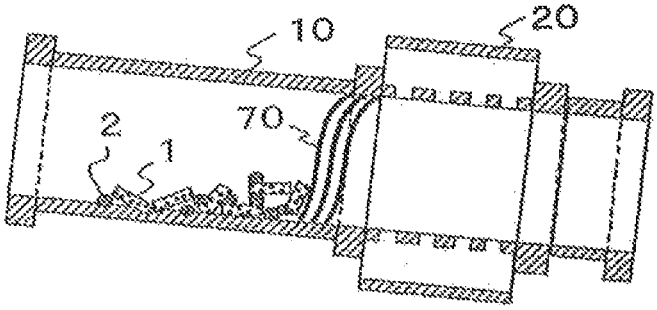
Figure 4:
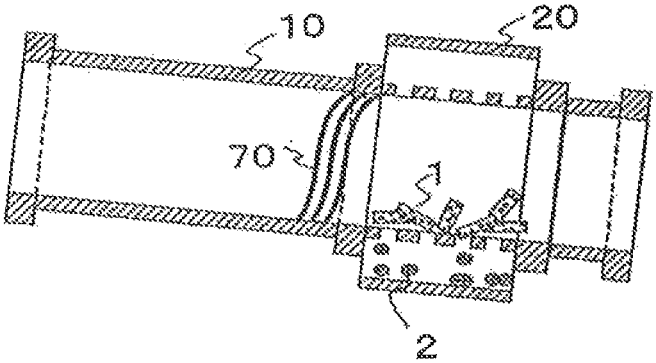
Figure 4:
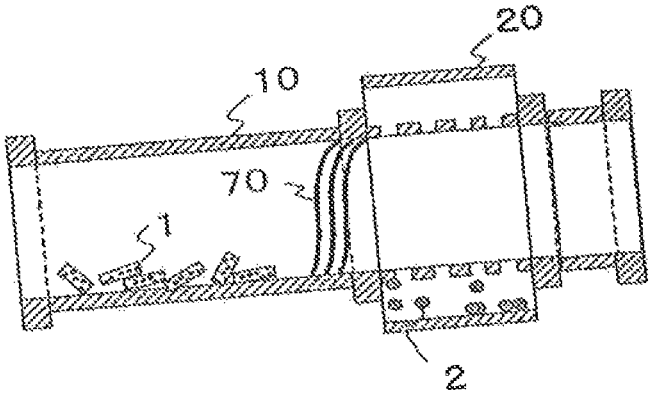
Figure 5:
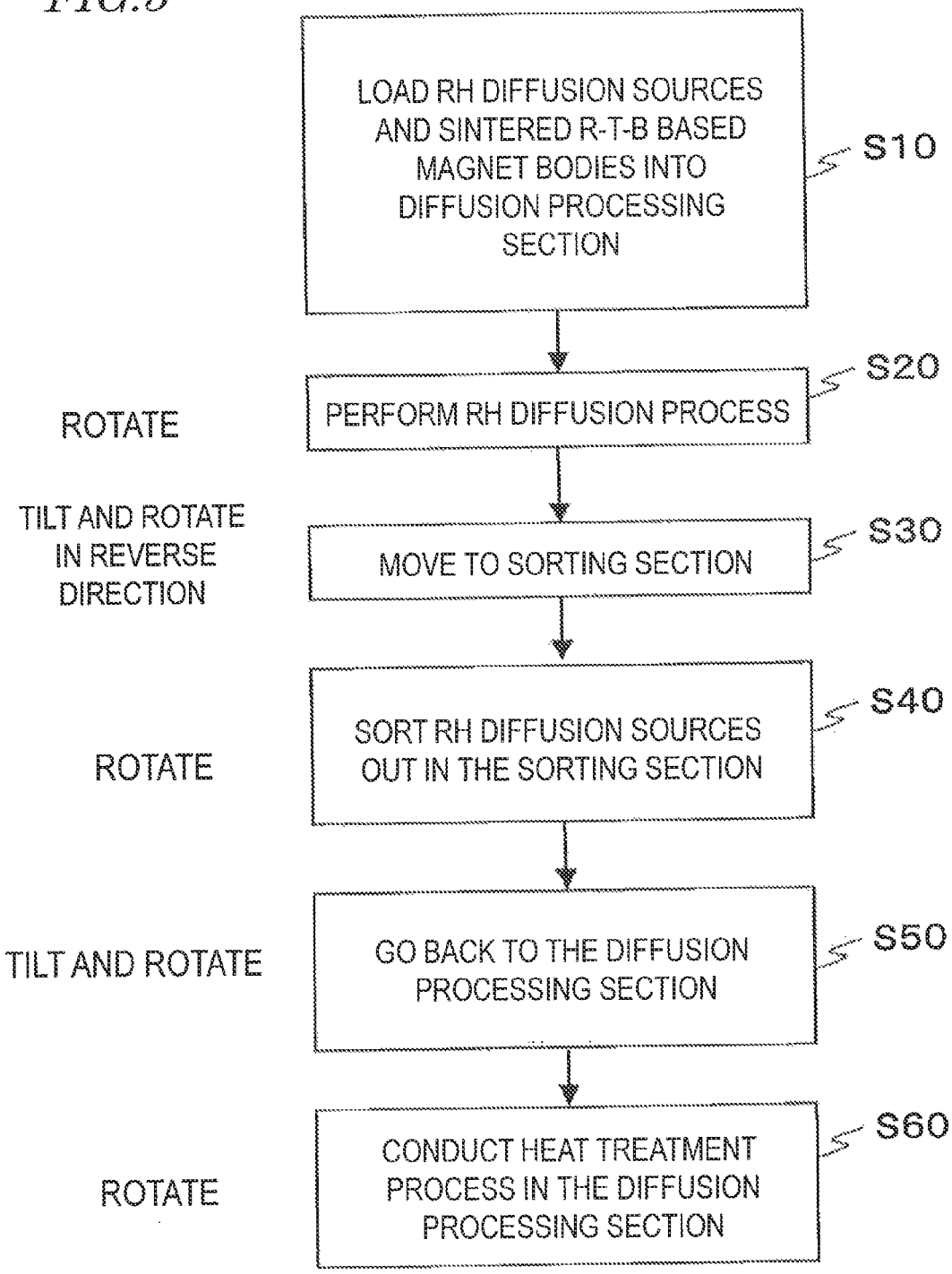
FIG. 5 A flowchart showing how to produce a sintered R-T-B based magnet using the system shown in FIG. 1.

First of all, in Step S10 shown in FIG. 5, sintered R-T-B based magnet bodies 1 and RH diffusion sources 2 are loaded into the diffusion processing section 10 shown in FIG. 4(*a*) so as to be movable with respect to each other and be brought close to, or into contact with, each other. In this case, the sintered R-T-B based magnet bodies 1 and the RH diffusion sources 2 have already been mixed together and are supplied by a feeder (not shown). The diffusion processing section 10 and the sorting section 20 may be arranged so that its inner wall portion is leveled as shown in FIG. 4(*a*) or tilted.

The RH diffusion sources 2 may be made of a heavy rare-earth element RH which is at least one of Dy and Tb or an alloy including the element(s). If the RH diffusion sources 2 are made of an alloy, the alloy suitably includes 30 mass % or more of the heavy rare-earth element RH. Each of the RH diffusion sources 2 has a smaller size than each sintered R-T-B based magnet body 1.

Optionally, although not shown in FIG. 4, a stirring aid member may be used in order to make the sintered R-T-B based magnet bodies 1 and the RH diffusion sources 2 contact with each other more frequently. The stirring aid member plays not only the role of bringing the RH diffusion sources into contact with the sintered R-T-B based magnet bodies more often but also the role of minimizing chipping due to collision of the sintered R-T-B based magnet bodies themselves. The stirring aid member may be made of zirconia, boron nitride, silicon nitride, silicon carbide or a ceramic that includes any combination of these compounds. Alternatively, the stirring aid member may also be made of an element belonging to the group including Mo, W, Nb, Ta, Hf and Zr or a mixture thereof. These materials do not easily react with the RH diffusion sources, and therefore, contribute immensely to sorting out the RH diffusion sources 2 from the sintered R-T-B based magnet bodies 1. Also, the stirring aid member is suitably smaller than the sintered R-T-B based magnet body but larger than the RH diffusion source.

Next, in Step S20 shown in FIG. 5, an RH diffusion process is started. This RH diffusion process is carried out by heating both the sintered R-T-B based magnet bodies 1 and the RH diffusion sources 2 while rotating the diffusion processing section 10 in the position shown in FIG. 4(*a*). In this processing step, the diffusion processing section 10 is suitably rotated in the level position. However, if the sorting section is tilted downward, then the diffusion processing section 10 needs to be rotated in such a direction in which the first baffle can prevent the sintered R-T-B based magnet bodies 1 and RH diffusion sources 2 from moving into the sorting section 20.

The RH diffusion sources 2 suitably have such a shape that the points of contact between the sintered R-T-B based magnet bodies 1 and the RH diffusion sources 2 can move quickly as the diffusion processing section 10 rotates. Specifically, the surface of the RH diffusion sources 2 is suitably curved. Examples of recommended shapes of the RH diffusion sources 2 include spherical, ellipsoidal, and circular cylindrical ones.

The inside of the diffusion processing section 10 may be coupled to an exhaust system such as a pump. By running the exhaust system, the inside of the diffusion processing section 10 can have its pressure lowered or raised while being shut off from the air (i.e., in an airtight state). Alternatively, an inert gas such as Ar gas may be introduced from a gas cylinder (not shown) into the inside of the diffusion processing section 10.

The diffusion processing section 10 is heated by a heater (not shown). And the sintered R-T-B based magnet bodies 1 and RH diffusion sources 2 housed inside the diffusion processing section 10 are also heated by the heater. The diffusion processing section 10 is supported rotatably around the center axis and can also be turned by the motor even while being heated by the heater. The surface velocity of the inner wall portion of the diffusion processing section 10 may be set to be 0.01 m/s or more. To avoid chipping the sintered R-T-B based magnet bodies due to their violent collision caused by the rotation, the surface velocity is suitably set to be 0.5 m/s or less.

During the RH diffusion process, an inert atmosphere is suitably maintained in the diffusion processing section 10. In this description, the "inert atmosphere" refers to a vacuum or an inert gas. Also, the "inert gas" may be a rare gas such as argon (Ar) gas but may also be any other gas as long as the gas is not chemically reactive between the sintered R-T-B based magnet bodies 1 and the RH diffusion sources 2. If the pressure of the atmospheric gas inside the diffusion processing section 10 were close to the atmospheric pressure, then the heavy rare-earth element RH would not be supplied easily from the RH diffusion sources 2 onto the surface of the sintered R-T-B based magnet bodies 1 according to the technique disclosed in Patent Document No. 1. However, since the RH diffusion sources 2 and the sintered R-T-B based magnet bodies 1 are arranged either close to, or in contact with, each other, in a preferred embodiment of the present invention, the heavy rare-earth element RH can be supplied at an increased rate. That is why the pressure of the atmospheric gas in the diffusion processing section 10 may just be equal to or lower than the atmospheric pressure. Also, there is relatively weak correlation between the degree of vacuum and the amount of the heavy rare-earth element RH supplied. Thus, even if the degree of vacuum were further increased, the amount of the heavy rare-earth element RH supplied would not change significantly. According to the present invention, the amount of the heavy rare-earth element RH supplied can be adjusted by controlling the temperature of the sintered R-T-B based magnet bodies.

In this embodiment, first of all, those sintered R-T-B based magnet bodies 1 and RH diffusion sources 2 that have been loaded into the diffusion processing section 10 are heated to a temperature of 500° C. to 1000° C. and maintained at that temperature for a predetermined period of time. In the meantime, the diffusion processing section 10 is rotated according to this embodiment.

In that temperature range of 500° C. to 1000° C., a rare-earth element can certainly diffuse in the sintered R-T-B based magnet bodies 1. When the present inventors carried out a heat treatment while bringing the RH diffusion sources 2 into contact with the sintered R-T-B based magnet bodies 1, we discovered that the heavy rare-earth element RH did diffuse inside of the sintered R-T-B based magnet bodies 1 and did contribute to increasing their coercivity. The diffusion could be produced successfully in such a temperature range probably because the distance between the RH diffusion sources and the sintered R-T-B based magnet bodies decreased sufficiently by bringing them either close to each other or in contact with each other.

The temperature and duration of the RH diffusion process are determined by taking into account the ratio of the overall volume of the sintered R-T-B based magnet bodies 1 to that of the RH diffusion sources 2 loaded when the RH diffusion process is carried out, the shape of the sintered R-T-B based magnet bodies 1, the composition and shape of the RH diffusion sources 2, the amount of the heavy rare-earth element RH (diffused and) supplied to the sintered R-T-B based magnet bodies 1 as a result of the RH diffusion process, and whether the stirring aid member is introduced or not.

In this embodiment, the diffusion processing section is rotated so that the sintered R-T-B based magnet bodies 1 and the RH diffusion sources 2 are movable with respect to each other and can be readily brought close to, or in contact with, each other. That is why the sintered R-T-B based magnet bodies 1 and the RH diffusion sources 2 move either continuously or discontinuously. As a result, the RH diffusion can be carried out just as intended. That is to say, the sintered R-T-B based magnet bodies 1 and the RH diffusion sources 2 do not stay in contact with, or close to, each other at a certain fixed position for a long time, but they repeatedly come into, and out of, contact with each other at one position after another either continuously or discontinuously. And yet the heavy rare-earth element RH can be supplied from the RH diffusion sources 2 to the sintered R-T-B based magnet bodies 1 in the meantime.

By heating the RH diffusion sources 2 including the heavy rare-earth element RH and the sintered R-T-B based magnet bodies 1 while moving them either continuously or discontinuously in this manner, the heavy rare-earth element RH can be diffused inside of the sintered R-T-B based magnet bodies 1 while being supplied from the RH diffusion sources 2 onto the surface of the sintered R-T-B based magnet bodies 1.

It should be noted that "the sintered R-T-B based magnet bodies and the RH diffusion sources are loaded so as to be movable with respect to each other and be readily brought close to, or into contact with, each other" means preventing the RH diffusion sources 2 and the sintered R-T-B based magnet bodies 1 from staying in contact with, or close to, each other at a certain fixed position for a long time (e.g., at 1000° C. for two minutes or more) by making the sintered R-T-B based magnet bodies 1 and the RH diffusion sources 2 move either continuously or discontinuously in the diffusion processing section during the RH diffusion processing step after the loading processing step. Consequently, unlike Patent Document No. 1, there is no need according to the present invention to arrange the sintered R-T-B based magnet bodies 1 and the RH diffusion sources 2 at predetermined positions.

Sorting

Next, Step S30 shown in FIG. 5 is performed. Specifically, by rotating the diffusion processing section 10 with the sorting section 20 tilted downward as shown in FIG. 4(*b*), the sintered R-T-B based magnet bodies 1 and the RH diffusion sources 2 in the diffusion processing section 10 are moved to the sorting section 20. At this point in time, to carry the RH diffusion sources 2 and the sintered R-T-B based magnet bodies 1 to the sorting section 20, the first baffle 70 may be connected to the inner wall portion of the diffusion processing section 10 by welding, for example, as shown in FIG. 3(*a*), thereby making the first baffle 70 rotate along with the diffusion processing section 10. Alternatively, instead of connecting the baffle to the inner wall portion, the baffle may also be connected to a shaft extended from the inlet port and rotate by itself. In any case, the rotational direction of the diffusion processing section 10 is determined so that the sintered R-T-B based magnet bodies 1 and the RH diffusion sources 2 move to the sorting section 20 as the diffusion processing section 10 rotates.

The sorting section 20 is configured to selectively eject the RH diffusion sources 2. In a preferred embodiment, the holes are cut through the inner wall portion of the sorting section 20 so as to have a size that is larger than that of the RH diffusion sources 2 but smaller than that of the sintered R-T-B based magnet bodies 1.

The inner wall of the sorting section may be a net made of a thermally resistant material or a metallic plate with a number of holes.

By rotating the sorting section 20 in the tilted position, the RH diffusion sources 2 drop out of the sorting section 20 through the holes of the inner wall of the sorting 20 as shown in FIG. 4(*c*) (in Step S40 shown in FIG. 5). Even after the RH diffusion sources 2 have dropped, the sorting section 20 still keeps rotating. Since the size of the holes of the inner wall portion of the sorting section 20 is determined so that only the sintered R-T-B based magnet bodies 1 are left there, the RH diffusion sources 2 are ejected out of the sorting section 20 through the inner wall portion of the sorting section 20 as the sorting section 20 rotates. The RH diffusion sources 2 that have dropped are collected in a container through a valve (not shown).

In this case, if any RH diffusion sources 2 were left in the sorting section 20, then the sorting section 20 could get leveled again and have its bottom shaken to make those RH diffusion sources 2 left in the sorting section 20 drop out of the sorting section 20 through the inner wall of the sorting section 20.

In another embodiment, the sorting section 20 shown in FIGS. 1 and 2 may be replaced with a net which is arranged as an alternative sorting section at the end of the diffusion processing section 10, and only the RH diffusion sources 2 may be caught in the sorting section. In this case, the sieve size of the net may be defined so that the sintered R-T-B based magnet bodies 1 remain in the diffusion processing section 10. Thus, if the diffusion processing section 10 is tilted so that its end in contact with the sorting section faces down, the RH diffusion sources 2 move through the holes of the net into the sorting section, while the sintered R-T-B based magnet bodies 1 remain in the diffusion processing section 10.

Heat Treatment

After the RH diffusion processing step and the sorting processing step have been performed, an additional heat treatment process is carried out on the sintered R-T-B based magnet bodies 1 in order to diffuse even more uniformly the heavy rare-earth element RH that has already been diffused. For that purpose, first, the sintered R-T-B based magnet bodies 1 are brought from the sorting section 20 back to the diffusion processing section 10 again. Specifically, with the sorting section 20 and the diffusion processing section 10 tilted downward as shown in FIG. 4(*d*), the rotational direction of the diffusion processing section 10 is selected so that as the diffusion processing section 10 rotates, the first baffle 70 passes the sintered R-T-B based magnet bodies 1 from the sorting section 20 to the diffusion processing section 10. In this manner, the sintered R-T-B based magnet bodies 1 are brought back to the diffusion processing section 10 again as shown in FIG. 4(*d*) (in Step S50 shown in FIG. 5).

If a net is arranged at the end of the diffusion processing section 10 in the alternative embodiment of the sorting section described above, the sintered R-T-B based magnet bodies 1 have not moved to the sorting section 20, and therefore, there is no need to perform the step of bringing the sintered R-T-B based magnet bodies 1 from the sorting section 20 back to the diffusion processing section 10 again.

After the sintered R-T-B based magnet bodies 1 have been brought back to the diffusion processing section 10, the heat treatment is carried out with the diffusion processing section rotated. The heat treatment may be conducted at a temperature of 500° C. to 1000° C., for example (in Step S60 shown in FIG. 5). In this heat treatment process, no heavy rare-earth element RH is further supplied onto the sintered R-T-B based magnet bodies 1 but the heavy rare-earth element RH does diffuse inside of the sintered R-T-B based magnet bodies 1. As a result, the heavy rare-earth element RH diffusing from the surface of the sintered R-T-B based magnet bodies 1 can reach deep inside, and the magnets as a whole can eventually have increased coercivity. This heat treatment process may be carried out for a period of time of 10 minutes to 72 hours, for example, and suitably for 1 to 6 hours. Subsequently, after the furnace is gradually cooled to an ordinary temperature, the sintered R-T-B based magnet bodies 1 that have been subjected to this heat treatment process are ejected through the inlet port 15.

If the heat treatment process were advanced with the sintered R-T-B based magnet bodies 1 and the RH diffusion sources 2 kept close to each other for a long time, then the heavy rare-earth element RH would be supplied excessively to eventually form an RH coating on the surface of the sintered R-T-B based magnet bodies 1, which is a problem. However, since the heat treatment process is carried out according to this embodiment after the RH diffusion sources 2 have been removed, such a problem can be avoided.

The processing system of this embodiment includes the sorting section that selectively sorts out the RH diffusion sources 2 after the RH diffusion process in which the heavy rare-earth element RH is supplied onto the surface of the sintered R-T-B based magnet bodies 1 by bringing the sintered R-T-B based magnet bodies 1 and the RH diffusion sources 2 close to, and out of contact with, each other repeatedly. That is why the RH diffusion processing step through the heat treatment processing step can be carried out so smoothly that sintered R-T-B based magnets with increased coercivity can be obtained with significantly increased productivity and without decreasing the remanence.

If the magnetocrystalline anisotropy of a sintered R-T-B based magnet is increased on the outer periphery of its main phase crystal grains by forming a heavy rare-earth element replaced layer on the outer periphery of the main phase with the heavy rare-earth element RH diffused from outside of the main phase crystal grains, the coercivity $H_{cJ}$ of the entire main phase increases effectively. According to the present invention, a heavy rare-earth element replaced layer can be formed on the outer periphery of the main phase not just in a region close to the surface of the sintered R-T-B based magnet bodies 1 but also in a region deep under the surface of the sintered R-T-B based magnet bodies 1, and therefore, the coercivity $H_{cJ}$ can be increased. However, since the heavy rare-earth element replaced layer is so thin that the heavy rare-earth element RH hardly diffuses into the core of the main phases, the remanence $B_r$ hardly decreases.

In addition, according to this embodiment, the time it would otherwise take to arrange the sintered R-T-B based magnet bodies 1 and the RH diffusion sources 2 at predetermined positions in the RH diffusion processing system can be saved.

Figure 7:
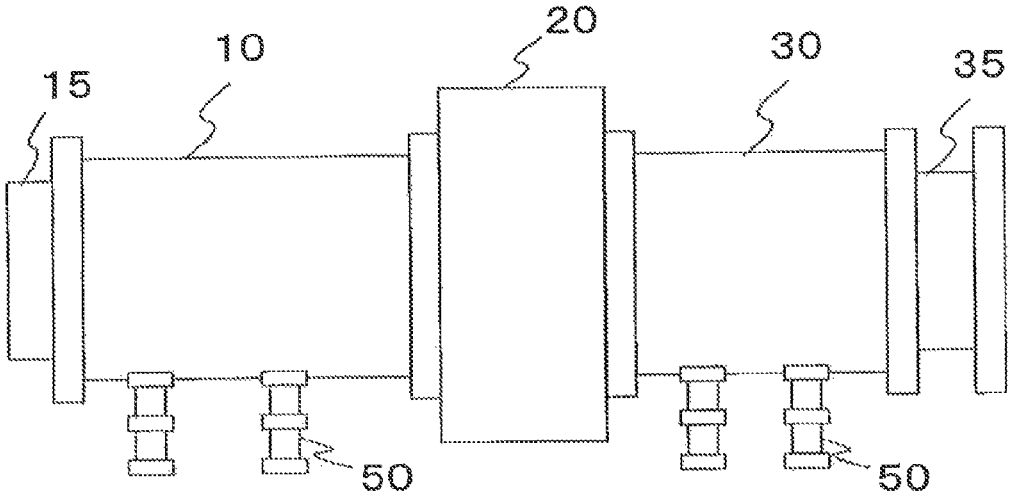
FIG. 7 Illustrates a configuration for a processing system as another embodiment of the present invention.

FIG. 7 generally illustrates another configuration for a processing system according to this embodiment. The processing system shown in FIG. 7 includes the diffusion processing section 10 that carries out the RH diffusion process, the sorting section 20 that selectively sorts the RH diffusion sources from the sintered R-T-B based magnet bodies when the RH diffusion sources and the sintered R-T-B based magnet bodies come from the diffusion processing section 10, and a heat treatment processing section 30 which carries out a heat treatment process on the sintered R-T-B based magnet bodies after the RH diffusion sources have been removed. The sorting section 20 also has the function of sending only the sintered R-T-B based magnet bodies that have been subjected to the RH diffusion process to the heat treatment processing section 30. In this example, the diffusion processing section 10, the sorting section 20 and the heat treatment processing section 30 can be tilted altogether.

In the processing system shown in FIG. 7, the sorting section 20 is interposed between the diffusion processing section 10 and the heat treatment processing section 30 and couples the diffusion processing section 10 and the heat treatment processing section 30 together. Thus, while sequentially going through the series of RH diffusion processing step, RH diffusion source sorting processing step, and heat treatment processing step, the sintered R-T-B based magnet bodies are never exposed to the air. In the RH diffusion source sorting processing step to be performed between the RH diffusion processing step and the heat treatment processing step, the RH diffusion sources are sorted out non-manually, and therefore, can be separated without lowering the processing temperature. As a result, the productivity can be increased from the RH diffusion processing step through the heat treatment processing step.

The diffusion processing section 10 has an inlet port 15, through which the sintered R-T-B based magnet bodies and RH diffusion sources yet to be subjected to the RH diffusion process are loaded into the diffusion processing section 10. On the other hand, the heat treatment processing section 30 has an outlet port 35, through which the sintered R-T-B based magnet bodies that have been subjected to the RH diffusion process and the heat treatment process will be unloaded from this processing system.

The diffusion processing section 10 and the heat treatment processing section 30 that are coupled together with the sorting section 20 are each composed of a connecting tube and supported to rotate on their center axis (not shown).

More specifically, a tilting mechanism 50 is provided to tilt the diffusion processing section 10, the sorting section 20 and the heat treatment processing section 30. Thanks to the action of the tilting mechanism 50, the diffusion processing section 10, the sorting section 20 and the heat treatment processing section 30 can be either leveled or tilted. The diffusion processing section 10, the sorting section 20 and the heat treatment processing section 30 can be rotated on their center axis by a motor (not shown). No matter whether they are leveled or tilted, the diffusion processing section 10, the sorting section 20 and the heat treatment processing section 30 can always rotate. And the direction and velocity of their rotation may be set arbitrarily.

Although the tilting mechanism 50 is supposed to be provided in this embodiment, the same effect can also be achieved even if the diffusion processing section 10, the sorting section 20 and the heat treatment processing section 30 are tilted altogether in advance at a predetermined angle.

Figure 8:
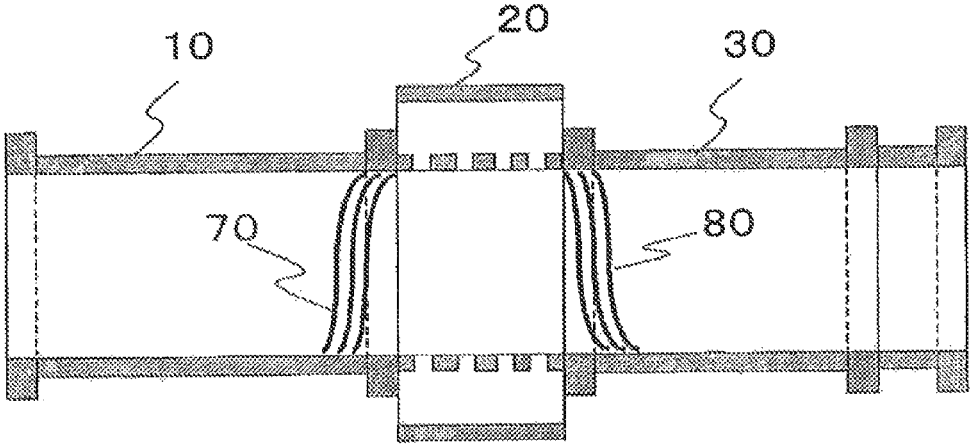
FIG. 8 Schematically illustrates a cross-sectional structure of the processing system according to the embodiment shown in FIG. 7.

Next, look at FIG. 8, which schematically illustrates a cross-sectional structure of the processing system shown in FIG. 7.

As shown in FIG. 8, the diffusion processing section 10 has an inner space to house the RH diffusion sources 2 and the sintered R-T-B based magnet bodies 1 and can forward the RH diffusion sources 2 and the sintered R-T-B based magnet bodies 1 to the sorting section 20 by rotating in the tilted position. Likewise, the heat treatment processing section 30 also has an inner space to house the sintered R-T-B based magnet bodies 1 and can unload the sintered R-T-B based magnet bodies 1 through the outlet port 35 by rotating in the tilted position, too. In the same way, by rotating in the tilted position, the sorting section 20 can eject only the RH diffusion sources 2 from among the RH diffusion sources 2 and the sintered R-T-B based magnet bodies 1.

It is recommended that the diffusion processing section 10 be made of a material that can withstand the heat at approximately 500 to 1000° C. and that does not easily react with the sintered R-T-B based magnet bodies 1 or the RH diffusion sources 2 at least on its inner wall portion, which may be made of a metal selected from the group consisting of Nb, Mo, W and Ta or an alloy including at least one of these elements. Alternatively, the inner wall portion of the diffusion processing section 10 may also be made of an Fe—Cr—Al based alloy or an Fe—Cr—Co based alloy. The same can be said about the sorting section 20 and the heat treatment processing section 30 to be described later.

In FIG. 8, a first spiral baffle 70 is also arranged inside of the diffusion processing section 10. When the diffusion processing section 10 rotates in a first direction, the first baffle 70 can pass the RH diffusion sources 2 and the sintered R-T-B based magnet bodies 1 to the sorting section 20. On the other hand, if the diffusion processing section 10 rotates in a second direction which is opposite to the first direction, the first baffle 70 can keep the RH diffusion sources 2 and the sintered R-T-B based magnet bodies 1 in the diffusion processing section 10. Likewise, the second spiral baffle 80 shown in FIG. 3(*b*) is arranged inside of the heat treatment processing section 30. The second baffle 80 is arranged so that its spiral direction is reverse to that of the first baffle 70. Thus, when the heat treatment processing section 30 rotates in the first direction, the second baffle 80 keeps the sintered R-T-B based magnet bodies 1 in the sorting section 20. On the other hand, if the heat treatment processing section 30 rotates in the second direction, the second baffle 80 can pass the sintered R-T-B based magnet bodies 1 in the sorting section 20 to the heat treatment processing section 30.

The first and second baffles 70 and 80 are ordinarily fixed to the inner wall portion. The gap between the inner wall portion 14 and the first baffle 70 and the gap between the inner wall portion 14 and the second baffle 80 are set so as to prevent the RH diffusion sources and sintered R-T-B based magnet bodies introduced from dropping through the gap.

Hereinafter, it will be described with reference to FIGS. 9(*a*) through 9(*d*) and FIG. 10 exactly how the processing system shown in FIGS. 7 and 8 operates.

RH Diffusion Process

Figure 9:
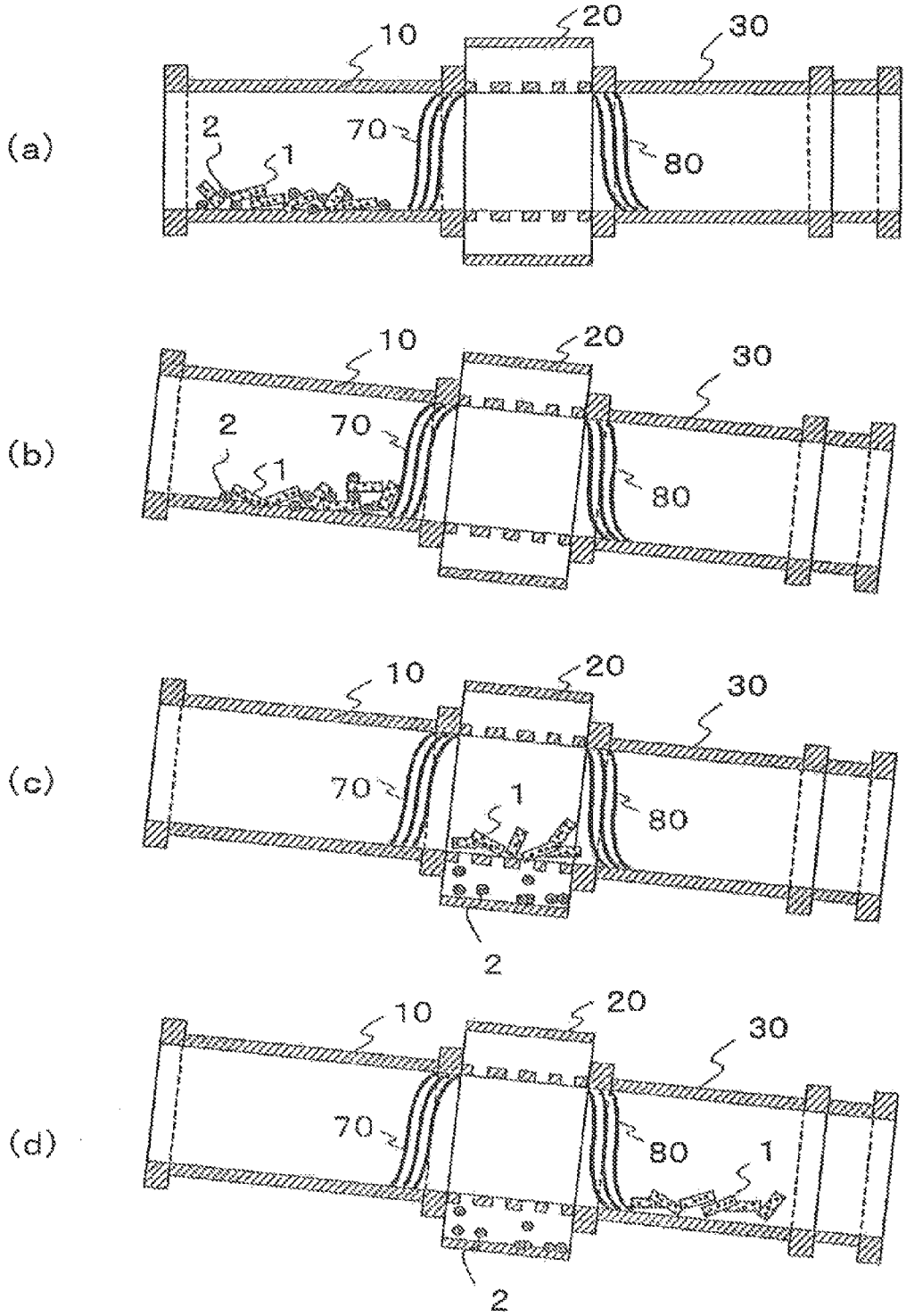
FIG. 9 (*a*) through (*d*) illustrate how the processing system according to the embodiment shown in FIG. 7 operates.
Figure 10:
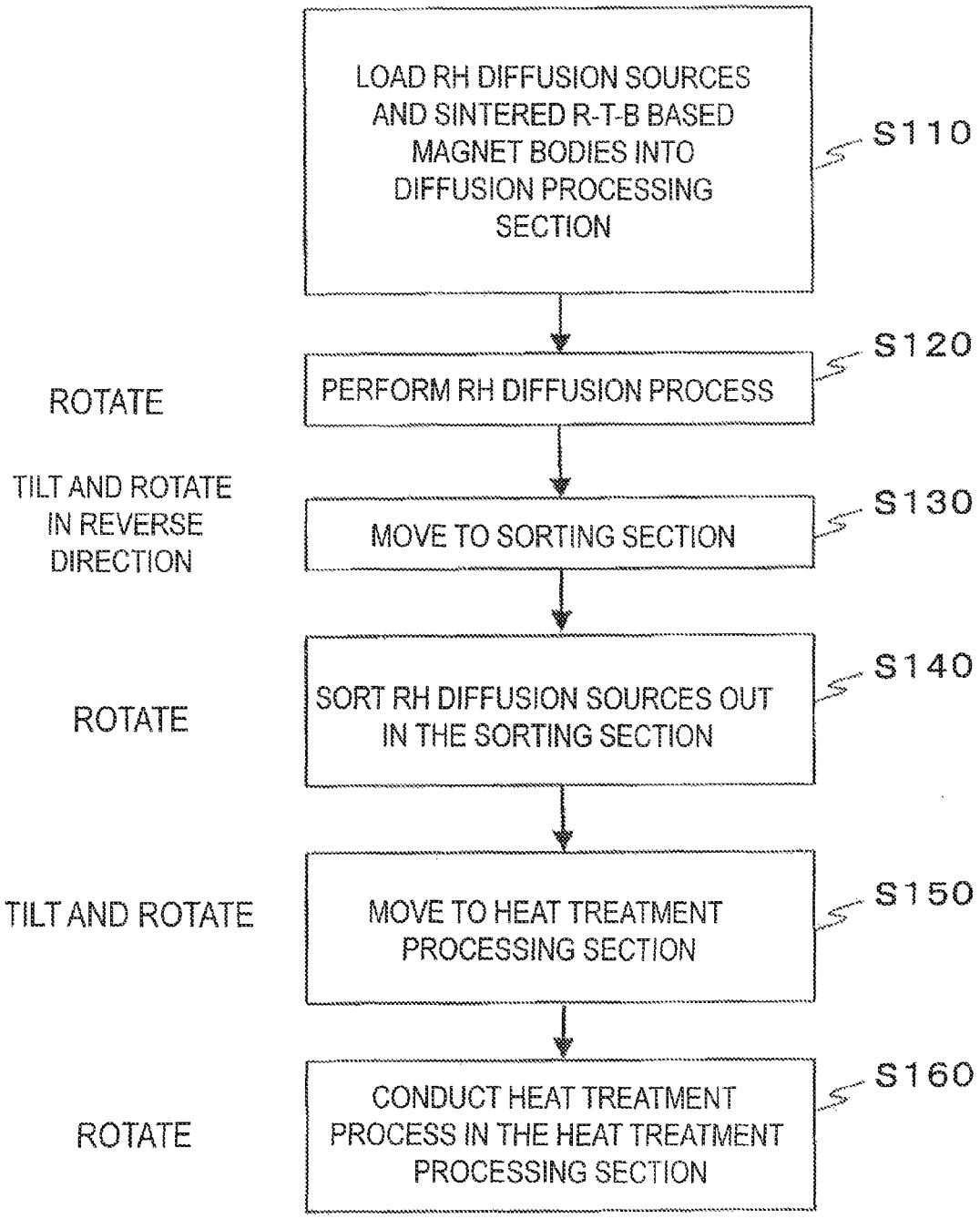
FIG. 10 A flowchart showing how to produce a sintered R-T-B based magnet using the system shown in FIG. 7.

First of all, in Step S110 shown in FIG. 10, sintered R-T-B based magnet bodies 1 and RH diffusion sources 2 are loaded into the diffusion processing section 10 shown in FIG. 9(*a*). In this case, the sintered R-T-B based magnet bodies 1 and the RH diffusion sources 2 have already been mixed together and are supplied by a feeder (not shown). In this case, the size of the RH diffusion sources 2 is adjusted to be smaller than that of the sintered R-T-B based magnet bodies 1.

Loading into the diffusion processing section 10 is carried out with the feeder (not shown) shaken or with the inlet port inclined. In this case, if the diffusion processing section 10 is rotated, then the sintered R-T-B based magnet bodies 1 and the RH diffusion sources 2 can be loaded smoothly into the diffusion processing section 10.

Alternatively, with the diffusion processing section 10, the sorting section 20 and the heat treatment processing section 30 leveled as shown in FIG. 9(*a*), a screw conveyor may be used to load the sintered R-T-B based magnet bodies 1 and the RH diffusion sources 2 into the diffusion processing section 10.

Next, in Step S120 shown in FIG. 10, an RH diffusion process is started. This RH diffusion process is carried out by heating both the sintered R-T-B based magnet bodies 1 and the RH diffusion sources 2 while stirring them up with the diffusion processing section 10 rotated in the position shown in FIG. 9(*a*). In this processing step, the diffusion processing section 10 is suitably rotated in the level position.

In the other respects, the RH diffusion process is carried out under the same condition as what has already been described with reference to FIG. 4(*a*).

Sorting

Next, Step S130 shown in FIG. 10 is performed. Specifically, by rotating the diffusion processing section 10 in the tilted position as shown in FIG. 9(*b*), the sintered R-T-B based magnet bodies 1 and the RH diffusion sources 2 are moved to the sorting section 20.

In this processing step, by rotating the diffusion processing section 10 in the reverse direction to the one adopted in the RH diffusion process, the first baffle 70 can pass the sintered R-T-B based magnet bodies 1 and the RH diffusion sources 2 to the sorting section 20 as the diffusion processing section 10 rotates.

The inner wall portion of the sorting section 20 has holes. And the sorting section 20 is configured to make the RH diffusion sources 2 drop out of the sorting section 20 through the holes of its inner wall portion (in Step S140 shown in FIG. 10) and selectively eject the RH diffusion sources 2 out of itself.

In this case, the size of the holes is set to be larger than the RH diffusion source 2 but smaller than the sintered R-T-B based magnet body 1.

With such setting adopted, by rotating the diffusion processing section 10 in the tilted position, the sintered R-T-B based magnet bodies 1 and the RH diffusion sources 2 are moved to the sorting section 20, in which the RH diffusion sources 2 are sorted out from the sintered R-T-B based magnet bodies 1 and from which only the RH diffusion sources 2 are ejected. In a preferred embodiment, the inner wall portion may be implemented as a net or a metallic plate with a number of holes.

In this processing step, if a stirring aid member is used, it depends on the shape, weight and other factors of the sintered R-T-B based magnet bodies whether the stirring aid member is ejected along with the RH diffusion sources out of the sintered R-T-B based magnet bodies and sorting section or remains in the sorting section.

Optionally, this system may further include a mechanism that gets the sorting section 20 back to the leveled position again after the sintered R-T-B based magnet bodies 1 and the RH diffusion sources 2 have moved to the sorting section 20 and that shakes off the RH diffusion sources 2 by swinging the sorting section 20.

Heat Treatment

After the RH diffusion processing step has been performed, a heat treatment process is carried out on the sintered R-T-B based magnet bodies 1 in order to diffuse even more uniformly the heavy rare-earth element RH that has already been diffused. For that purpose, first, the sintered R-T-B based magnet bodies 1 are moved from the sorting section 20 to the heat treatment processing section 30. Specifically, with the sorting section 20 and the heat treatment processing section 30 tilted downward as shown in FIG. 9(*d*), the heat treatment processing section 30 is rotated in an appropriate direction. In this processing step, the second baffle 80 is arranged so as to pass the sintered R-T-B based magnet bodies 1 to the heat treatment processing section 30 as the heat treatment processing section 30 rotates (in Step S150 shown in FIG. 10). In this manner, the sintered R-T-B based magnet bodies 1 are moved to the heat treatment processing section 30 as shown in FIG. 9(*d*).

The heat treatment may be conducted at a temperature of 500° C. to 1000° C., for example (in Step S160 shown in FIG. 10). In this heat treatment process, no heavy rare-earth element RH is further supplied onto the surface of the sintered R-T-B based magnet bodies 1 but the heavy rare-earth element RH does diffuse inside of the sintered R-T-B based magnet bodies 1. As a result, the heavy rare-earth element RH diffusing from the surface of the sintered R-T-B based magnet bodies 1 can reach deep inside, and the magnets as a whole can eventually have increased coercivity. This heat treatment process may be carried out for a period of time of 10 minutes to 72 hours, for example, and suitably for 1 to 6 hours. Subsequently, after the furnace is gradually cooled to an ordinary temperature, the sintered R-T-B based magnet bodies 1 that have been subjected to this heat treatment process are ejected through the outlet port 35.

In this embodiment, the heat treatment process is carried out after the RH diffusion sources 2 have been removed, and therefore, it is possible to avoid forming an RH coating on the surface of the sintered R-T-B based magnet bodies 1.

The processing system of this embodiment also includes the sorting section that selectively sorts out the RH diffusion sources after the RH diffusion process in which the heavy rare-earth element RH is supplied onto the surface of the sintered R-T-B based magnet bodies by bringing the sintered R-T-B based magnet bodies and the RH diffusion sources close to, and out of contact with, each other repeatedly. That is why the RH diffusion processing step through the heat treatment processing step can be carried out so smoothly that sintered R-T-B based magnets with increased coercivity can be obtained with significantly increased productivity and without decreasing the remanence.

In the example illustrated in FIG. 9, the first baffle 70 is provided for the diffusion processing section 10. However, the first baffle 70 may also be arranged in the sorting section 20 or to cover both the diffusion processing section 10 and the sorting section 20. Likewise, the second baffle 80 may also be arranged in the sorting section 20 or to cover both the sorting section 20 and the heat treatment processing section 30.

The first and second baffles 70 and 80 are arranged so that the spiral direction of one of the two baffles is reverse to that of the other. That is why it is possible to prevent the sintered R-T-B based magnet bodies 1 from entering the heat treatment processing section 30 when the state changes from the one shown in FIG. 9(*b*) to the one shown in FIG. 9(*c*). If the second baffle 80 were arranged by translating the first baffle 70, then the sintered R-T-B based magnet bodies 1 would pass through the sorting section and reach the heat treatment processing section 30.

As can be seen from the foregoing description, according to this embodiment, the time it would otherwise take to arrange the sintered R-T-B based magnet bodies 1 and the RH diffusion sources 2 at predetermined positions in the RH diffusion processing system can also be saved.

INDUSTRIAL APPLICABILITY

The present invention is applicable to making a sintered R-T-B based magnet with high remanence and high coercivity. Such a magnet can be used effectively in various types of motors such as a motor for a hybrid car to be exposed to high temperatures and in numerous kinds of consumer electronic appliances.

REFERENCE SIGNS LIST

1 sintered R-T-B based magnet body
2 RH diffusion source
10 diffusion processing section
14 inner wall portion
15 inlet port
20 sorting section
30 heat treatment processing section
35 outlet port
50 tilting mechanism
70 first baffle
80 second baffle

The invention claimed is:

1. A processing system comprising:

a diffusion processing section which heats an RH diffusion source made of either a metal or alloy of a heavy rare-earth element RH (which is at least one of Dy and Tb) and a sintered R-T-B based magnet body while rotating;

a sorting section which is adjacent to the diffusion processing section and which selectively sorts the RH diffusion source from the sintered R-T-B based magnet body when the diffusion source and the magnet body come from the diffusion processing section;

a heat treatment processing section which is adjacent to the sorting section and which conducts a heat treatment process on the sintered R-T-B based magnet body, in which the heavy rare-earth element RH has been diffused by the diffusion processing section and from which the RH diffusion source has been removed, while rotating;

a tilting mechanism which changes at least the diffusion processing section, the sorting section, and the heat treatment processing section between a tilted position and a level position during a process including diffusion, sorting, and heat treatment steps; wherein the diffusion processing section:

includes a first cylindrical inner wall portion which houses the RH diffusion source and the sintered R-T-B based magnet body;

includes a first spiral baffle arranged on the first cylindrical inner wall portion; and passes the RH diffusion source and the sintered R-T-B based magnet body to the sorting section while being rotated;

the sorting section:

includes a second cylindrical inner wall portion which houses the RH diffusion source and the sintered R-T-B based magnet body and which has holes;

ejects the RH diffusion source through the holes out of itself while moving the RH diffusion source and the sintered R-T-B based magnet body that have come from the diffusion processing section toward the heat treatment processing section; and passes the sintered R-T-B based magnet body to the heat treatment processing section while being rotated;

the heat treatment processing section:

includes a third cylindrical inner wall portion which houses the sintered R-T-B based magnet body;

includes a second spiral baffle arranged on the third cylindrical inner wall portion; and ejects the sintered R-T-B based magnet body through an outlet port while being rotated; and the first spiral baffle is arranged so that its spiral direction is reverse to that of the second spiral baffle.

2. The processing system of claim 1, wherein the diffusion processing section has a first outer wall portion that surrounds the first inner wall portion, and wherein the sorting section has a second outer wall portion that surrounds the second inner wall portion, and wherein the heat treatment processing section has a third outer wall portion that surrounds the third inner wall portion, and wherein at least the first and third inner wall portions have a cylindrical shape and are made of either a metal or alloy including at least one of Mo, W, Nb and Ta.

3. The processing system of claim 1, wherein a sheet-like padding member is arranged between each said pair of inner and outer wall portions.

* * * * *